US010947984B1

(12) United States Patent
Gelina

(10) Patent No.: US 10,947,984 B1
(45) Date of Patent: Mar. 16, 2021

(54) GAS REMOVAL APPARATUS HAVING A HEAT SINK SURROUNDING A MOTOR

(71) Applicant: Jamey Gelina, Wellington, FL (US)

(72) Inventor: Jamey Gelina, Wellington, FL (US)

( * ) Notice: Subject to any disclaimer, the term of this patent is extended or adjusted under 35 U.S.C. 154(b) by 118 days.

(21) Appl. No.: 16/236,720

(22) Filed: Dec. 31, 2018

(51) Int. Cl.

| | |
|---|---|
| ***F04D 25/08*** | (2006.01) |
| ***F04D 29/58*** | (2006.01) |
| ***F24F 7/06*** | (2006.01) |
| ***F04D 17/16*** | (2006.01) |
| ***F04D 25/12*** | (2006.01) |
| ***F04D 25/06*** | (2006.01) |
| ***F04D 29/02*** | (2006.01) |
| ***F04D 27/00*** | (2006.01) |
| ***F04D 29/08*** | (2006.01) |
| ***E02D 31/00*** | (2006.01) |

(52) U.S. Cl.
CPC ..... *F04D 25/082* (2013.01); *F04D 29/5806* (2013.01); *F04D 29/5813* (2013.01); *E02D 31/008* (2013.01); *F04D 17/16* (2013.01); *F04D 25/0606* (2013.01); *F04D 25/12* (2013.01); *F04D 27/004* (2013.01); *F04D 29/023* (2013.01); *F04D 29/083* (2013.01); *F24F 7/065* (2013.01)

(58) Field of Classification Search
CPC ..... F24F 7/065; E02D 31/008; F04D 23/003; F04D 25/12; F04D 25/0693; F04D 29/403; F04D 29/5853; F04D 29/661
USPC ..... 454/15
See application file for complete search history.

(56) References Cited

U.S. PATENT DOCUMENTS

| | | | | |
|---|---|---|---|---|
| 4,978,281 | A * | 12/1990 | Conger, IV | F04D 25/082 264/271.1 |
| 5,083,500 | A * | 1/1992 | Francis | B08B 9/0495 454/341 |
| 2009/0246013 | A1* | 10/2009 | Kenyon | F04D 17/122 415/208.2 |
| 2011/0020149 | A1* | 1/2011 | Tsai | F04D 25/08 417/321 |
| 2012/0199129 | A1* | 8/2012 | Kenyon | F04D 29/4226 128/205.25 |
| 2015/0333589 | A1* | 11/2015 | De Filippis | H02K 11/00 310/71 |
| 2016/0298648 | A1* | 10/2016 | Graham | F04D 29/284 |

* cited by examiner

*Primary Examiner* — Bryan M Lettman
*Assistant Examiner* — Timothy P Solak
(74) *Attorney, Agent, or Firm* — Gulf Coast Intellectual Property Group

(57) ABSTRACT

A radon gas removal apparatus configured to provide evacuation of radon gas from a desired area or building. The radon gas removal apparatus includes an exterior housing forming an interior volume. Disposed within said interior volume is a motor assembly and a fan operably coupled. The motor assembly includes an upper portion having a metal housing wherein the upper portion has a cavity proximate the top thereof configured to store a circuit board. The cavity is hermetically sealed utilizing a lid member. A heat sink assembly is proximate the lower edge of the upper portion of the motor assembly. The heat sink assembly includes a central void configured to receive a motor therein. The heat sink includes a first wall and a second wall having a void intermediate configured to a heat sink material. A motor is present within the central void of the heat sink assembly.

8 Claims, 4 Drawing Sheets

GAS REMOVAL APPARATUS HAVING A HEAT SINK SURROUNDING A MOTOR

CROSS REFERENCE TO RELATED APPLICATIONS

This application is a continuation-in-part of U.S. patent application Ser. No. 15/937,408 filed, Mar. 27, 2018, now U.S. Pat. No. 10,689,825 entitled, Radon Removal Apparatus, inventor Jamey Gelina, which is hereby incorporated for reference.

FIELD OF THE INVENTION

The present invention relates generally to gas removing fans, more specifically but not by way of limitation, radon removal fan that is operable to evacuate accumulation of radon from a building wherein the present invention utilizes a direct current motor and an optimized housing therefore that provides improved operation.

BACKGROUND

Radon gas is known in the art to accumulate in buildings in certain environments. Radon gas is a naturally occurring gas that is produced in small quantities during the normal decay cycle of elements such as thorium. While radon gas production is small, it is continuously produced and as such it is considered a significant health risk. Radon gas is most often the largest single contributor to an individual's background radiation dose amount. In the United States, radon gas is the second leading gas of lung cancer behind smoking. Radon gas will enter a building at its lowest level and most often enters through cracks or other voids and will penetrate the structure.

Current technology employed to assist in the removal and accumulation prevention is to install radon fans in the lower levels of the building. Radon fans are typically mounted outside the structure on the wall thereof and function to vent any radon gas to the outside of the structure. One issue with existing radon fans is their inability to inhibit moisture accumulation within the housing and in particular the electronics installed to provide operation of the fan and motor. Soil vapor extraction and radon mitigation are prone to moisture accumulation and as such this leads to rapid corrosion of electronics disposed within the fan housing. Existing technology utilizes alternating current motors and electronics so as to couple to the existing electrical system of the building. Utilization of direct current motors and electronics is avoided as current configurations deploy the electronics in a position wherein they are susceptible to damage from moisture. Furthermore, heat accumulation is another challenge that must be addressed.

Accordingly, there is a need for a radon removal apparatus that is configured to provide removal of radon gas, wherein the present invention includes a motor assembly construction that provides elimination of moisture exposure to the electronics and further provides heat management.

SUMMARY OF THE INVENTION

It is the object of the present invention to provide a radon removal apparatus that is configured to evacuate radon from a building wherein the present invention includes an exterior housing that is operably coupled to an intake pipe.

Another object of the present invention is to provide a radon removal fan that is operable to inhibit radon from entering a building wherein the present invention employs a direct current electric motor operably coupled to the fan disposed in the exterior housing.

A further object of the present invention is to provide a radon removal apparatus that is configured to evacuate radon from a building that further includes a motor assembly having an upper portion and a lower portion.

Still another object of the present invention is to provide a radon removal fan that is operable to inhibit radon from entering a building wherein the upper portion of the housing includes a cavity configured to house electronics therein.

An additional object of the present invention is to provide a radon removal apparatus that is configured to evacuate radon from a building wherein the cavity of the upper portion is hermetically sealed.

Yet a further object of the present invention is to provide a radon removal fan that is operable to inhibit radon from entering a building that further includes a heat sink assembly proximate the lower end of the upper portion of the motor assembly.

Another object of the present invention is to provide a radon removal apparatus that is configured to evacuate radon from a building wherein the heat sink assembly is ring shaped having a central void configured to receive a direct current motor therein.

An alternate object of the present invention is to provide a radon removal fan that is operable to inhibit radon from entering a building that further includes a motor controller operable to facilitate the adjustment of speed of the fan motor.

Still a further object of the present invention is to provide a radon removal apparatus that is configured to evacuate radon from a building wherein the fan assembly is mounted in a boot member within the interior volume of the exterior housing.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
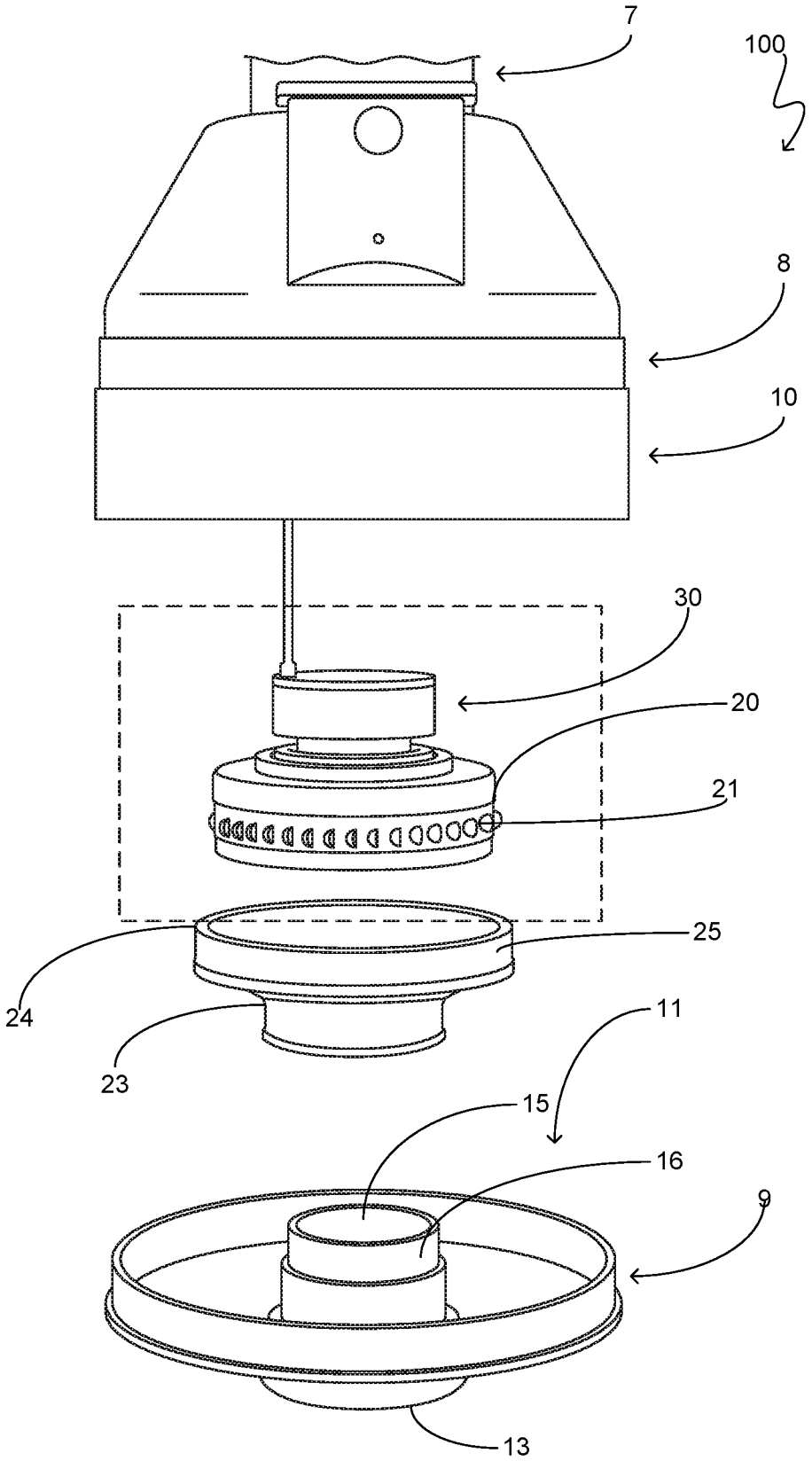
FIG. 1 is an exploded diagrammatic view of the preferred embodiment of the present invention.
Figure 2:
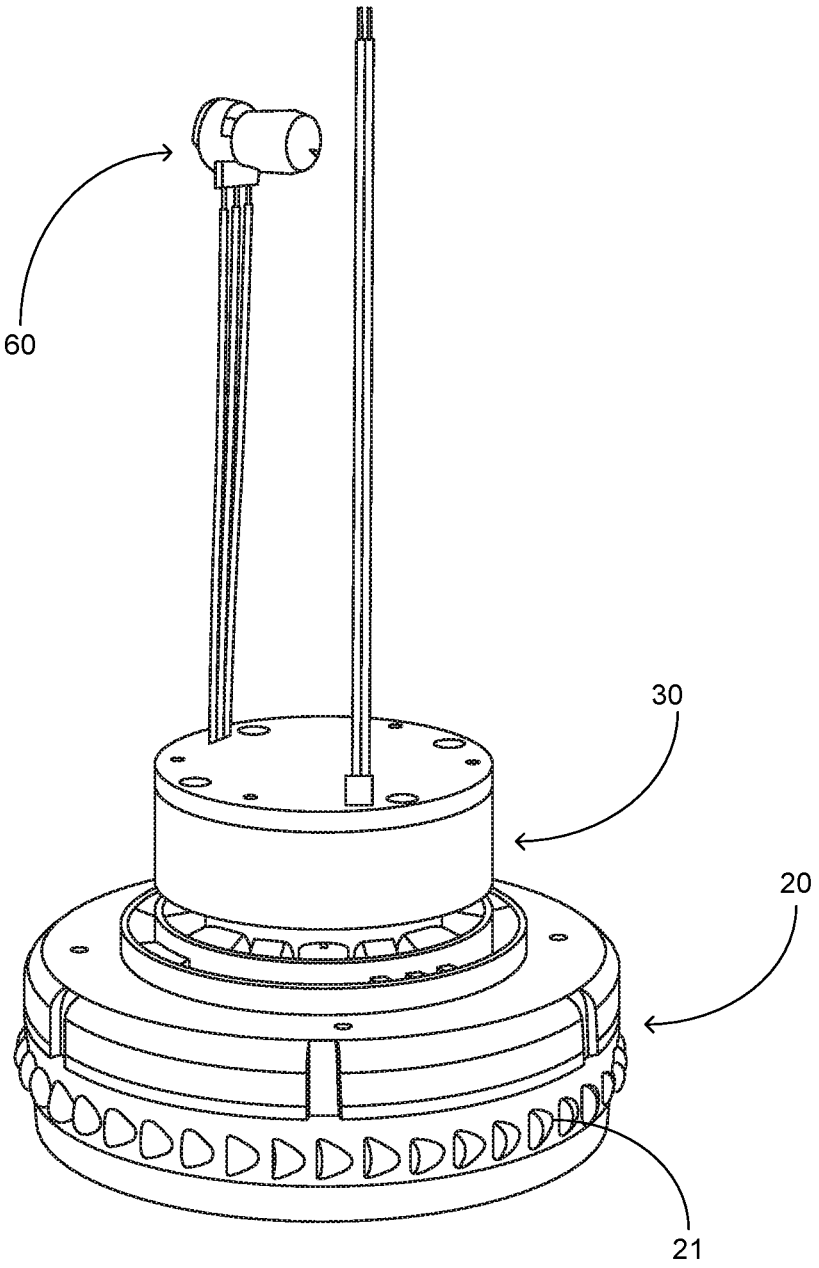
FIG. 2 is a detailed view of the motor assembly and fan of the present invention.

Referring now to the drawings submitted herewith, wherein various elements depicted therein are not necessarily drawn to scale and wherein through the views and figures like elements are referenced with identical reference numerals, there is illustrated a gas removal apparatus 100 constructed according to the principles of the present invention.

An embodiment of the present invention is discussed herein with reference to the figures submitted herewith.

Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular the Figures submitted as a part hereof, the radon removal apparatus 100 includes an exterior housing 10 wherein the exterior housing 10 includes an upper portion 8 and a lower portion 9 that are releasably secured utilizing suitable techniques. The exterior housing 10 is manufactured from a suitable durable material such as but not limited to plastic. The exterior housing 10 includes and interior volume 11 that is of suitable size to accommodate the fan 20 and motor assembly 30 therein. The lower portion 9 is annular in shape and includes a central bore 15 formed therein. The central bore 15 is bordered by inner wall 16 within the interior volume 11 of the exterior housing 10. The central bore 15 functions to atmospherically couple the fan 20 with the external environment wherein air flow is directed inwards into the central bore 15 as the exterior housing 10 is coupled to an intake pipe (not illustrated herein) at union 13. Fan 20 is disposed in mount 25. Mount 25 is operably coupled to wall 16 and is manufactured from a suitable material such as but not limited to rubber. In the preferred embodiment of the present invention the mount 25 is manufactured from rubber so as to inhibit the transfer of vibrations within the exterior housing 10 enabling a quieter operation. Mount 25 includes a lower portion 23 and an upper portion 24 that are integrally formed wherein the lower portion 23 has a diameter that is less than that of the upper portion 24. The lower portion 23 has a diameter that is configured to operably coupled with wall 16. The upper portion 24 includes cavity 26 that is configured to receive at least a portion of the fan 20 therein.

Fan 20 includes an impeller (not illustrated herein) disposed therein wherein the fan 20 is operably to intake air from the central bore 15 and expel the air from the output vents 21. As the fan expels the air outwards from the output vents 21 the air is directed upwards and egresses from the top 7 of the upper portion 8 of the exterior housing 10. The fan 20 is operably coupled to the motor assembly 30 as is further discussed herein. The fan 20 is a variable speed fan that is operably coupled to controller 60. Controller 60 is electronically coupled to the motor assembly 30 and is configured to provide user input for speed adjustment of the fan 20. While the controller 60 is illustrated herein as a control dial, it is contemplated within the scope of the present invention that the controller 60 could be provided in alternate configurations so as to provide the desired functionality of fan speed adjustment.

Figure 3:
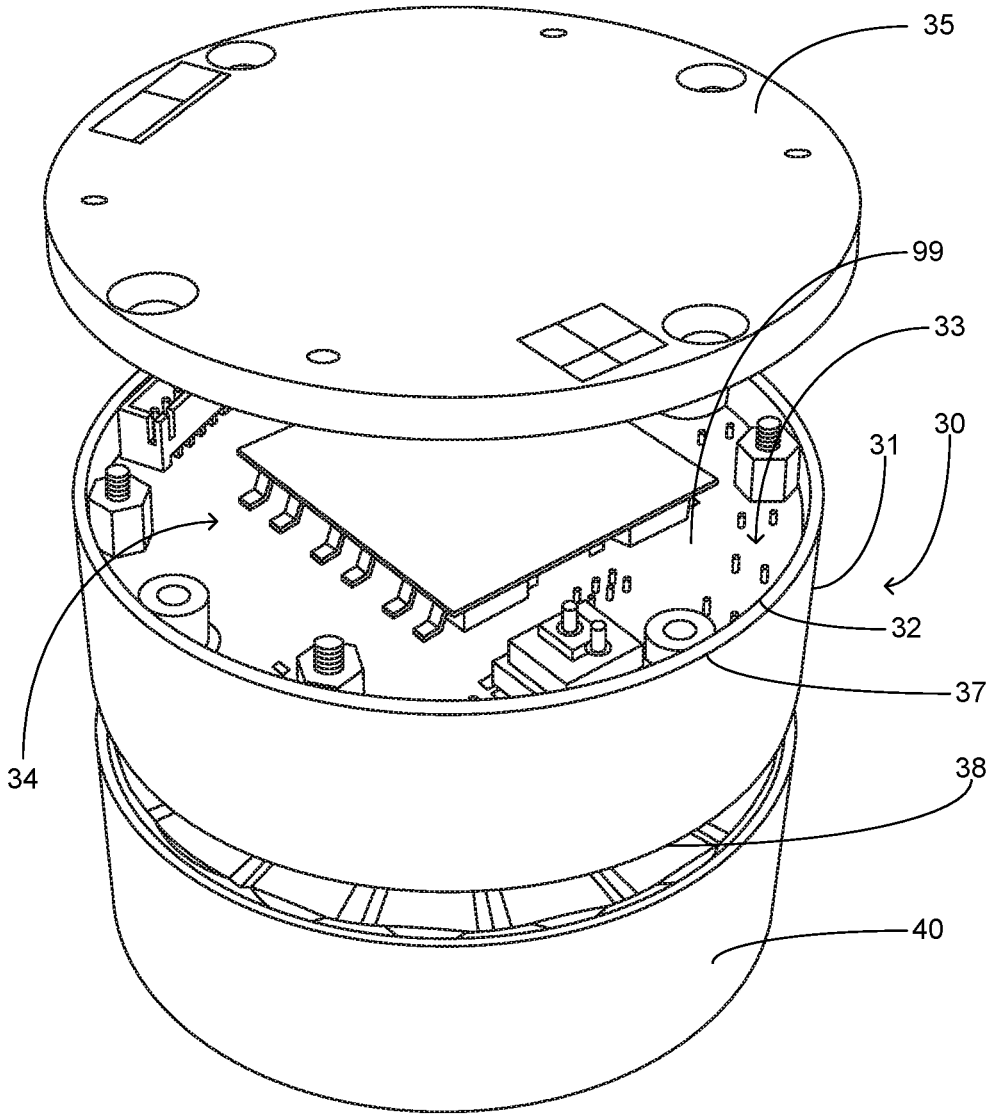
FIG. 3 is a detailed view of the upper portion of the motor assembly of the present invention.
Figure 4:
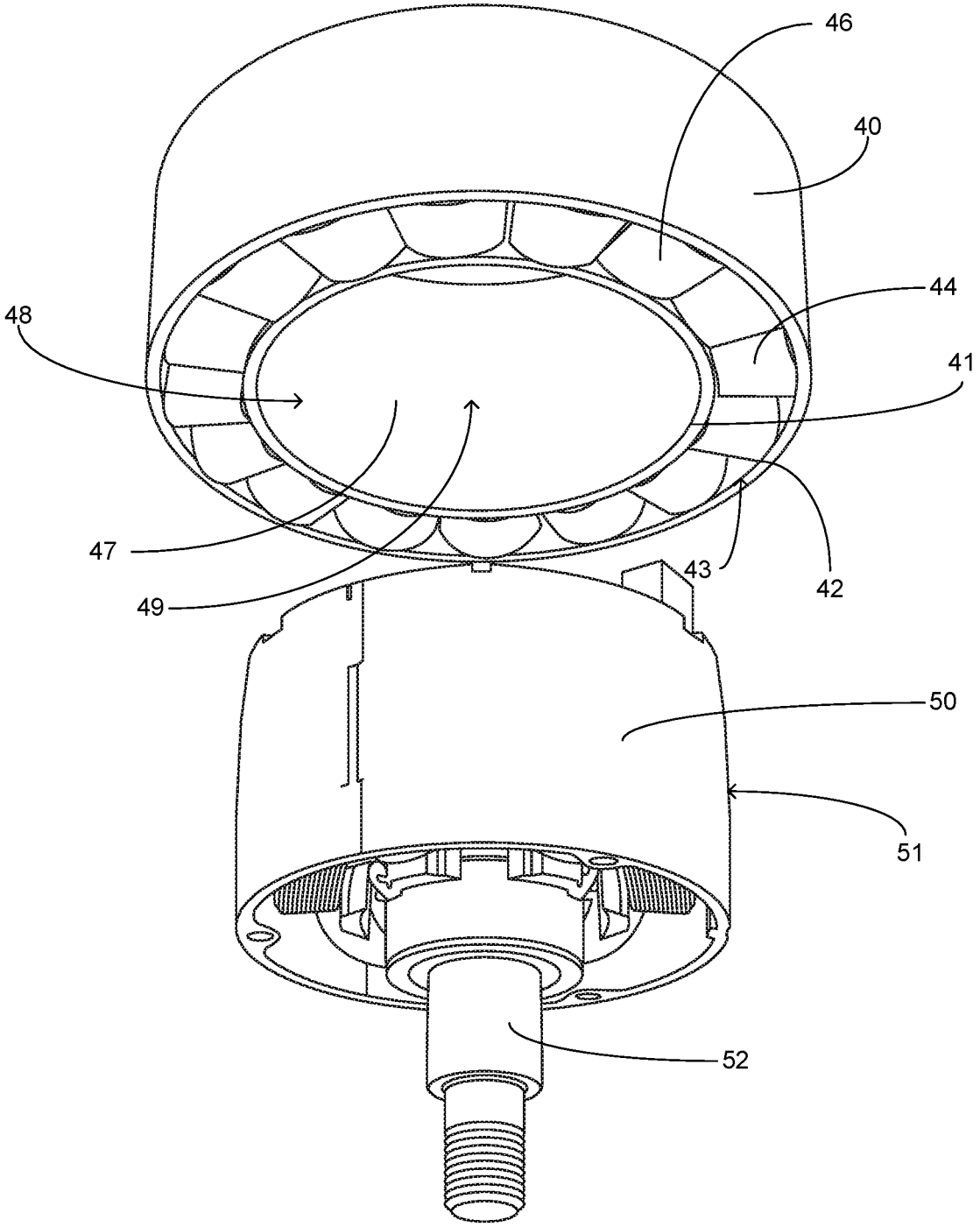
FIG. 4 is a detailed view of the motor and heat sink module of the present invention.

Referring in particular to FIG. 3, the motor assembly 30 includes upper portion 31. The motor assembly 30 is manufactured from a durable material such as but not limited to metal. Upper portion 31 is annular in shape and is formed with external wall 32 and bottom (not illustrated herein) so as to create an electronics cavity 33. The upper portion 31 includes opening 34 providing access to the electronics cavity 33. The opening 34 is sealably engaged with lid member 35. Lid member 35 is formed so as to mateably cover opening 34 and is secured thereover utilizing suitable durable techniques such as but not limited to mechanical fasteners. The lid member 35 is manufactured from a durable rigid material such as but not limited to metal. While not particularly illustrated herein, it is contemplated within the scope of the present invention that the lid member 35 could have a gasket formed thereon to ensure a desired seal between the lid member 35 and the top edge 37 of the external wall 32 of the upper portion 31. Lid member 35 is designed to provide a hermetic sealing of the opening 34. As has been discussed herein, the environmental conditions that are subjected to the gas removal apparatus 100 results in the accumulation of moisture. The electronics cavity 33 of the upper portion 31 is hermetically sealed so as to inhibit moisture accumulation and as such damage resulting therefrom to the circuit board 99. It is contemplated within the scope of the present invention that the upper portion 31 could be manufactured in alternate shapes and sizes. Furthermore, it should be understood within the scope of the present invention that the electronics cavity 33 could be formed in alternate sizes wherein the size is suitable to house a circuit board 99 therein.

Proximate the lower edge 38 of the upper portion 31 is the heat sink assembly 40. The heat sink assembly 40 includes inner wall 41 and outer wall 42 that are annular in shape. Inner wall 41 and outer wall 42 have a void 43 intermediate thereto wherein the void 43 is configured to have heat sink material 44 stored therein. The inner wall 41 and outer wall 42 are manufactured from a durable conducting material such as but not limited to aluminum. The heat sink material 44 stored within the void 43 is organized in a plurality of bundles 46 and is configured to transfer heat away from the motor 50. While no particular heat sink material 44 is required good results have been achieved by utilizing copper or aluminum to manufacture the bundles 44. The heat sink assembly 40 includes central void 47 having opening 48 providing access to hollow passage 49. The central void 47 is annular in shape and configured to receive the motor 50 therein. With motor 50 disposed within central void 47, heat generated therefrom is dissipated by heat sink assembly 40.

As the gas removal apparatus 100 is designed to operate in a substantially continuous mode, the heat sink assembly 40 inhibits the generation of heat at the motor 50. Further, the construction of the upper portion 31 as described herein provides an environment wherein the circuit board 99 is enclosed within the electronics cavity 33 so as to inhibit moisture accumulation proximate thereto. The structure of the motor assembly 30 as described herein provides an environment so as to prolong the operation of the gas removal apparatus 100.

The motor 50 is a conventional low voltage direct current motor that includes housing 51 manufactured from a durable material such as but not limited to metal. The motor 50 includes shaft 52 that is operably coupled to fan 20 so as to provide rotational operation thereof.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A gas removal apparatus operable to inhibit the accumulation of a gas within a structure comprising:

an exterior housing, said exterior housing having a lower portion and an upper portion, said lower portion of said exterior housing and said upper portion of said exterior housing being releasably secured, said exterior housing having an interior volume, said lower portion of said exterior housing having a central bore journaled therethrough, said lower portion of said exterior housing having a wall disposed within said interior volume of said exterior housing surrounding said central bore, said wall having a mounting member operably secured thereto, said mounting member having an upper portion and a lower portion, said upper and said lower portions of said mounting member being contiguously formed, said lower portion of said mounting member having a diameter that is less than that of the upper portion of said mounting member, said lower portion of said mounting member being coupled to the wall surrounding said central bore, said upper portion of said mounting member having a cavity, said mounting member being manufactured from rubber;

a fan, said fan being disposed within said interior volume of said exterior housing, said fan being disposed within said cavity of said mounting member;

a motor assembly, said motor assembly being operably coupled to said fan, said motor assembly having an upper portion, said upper portion of said motor assembly having a sidewall and a bottom defining an interior volume of said upper portion of said motor assembly, said upper portion of said motor assembly having an opening, said opening providing access to said interior volume of said upper portion of said motor assembly, said motor assembly having a lid member, said lid member configured to hermetically seal said interior volume of said upper portion of said motor assembly, said interior volume of said upper portion of said motor assembly having a circuit board disposed therein, said upper portion of said motor assembly having an upper edge and a lower edge;

a heat sink assembly, said heat sink assembly being proximate said lower edge of said upper portion of said motor assembly, said heat sink assembly having a first wall and a second wall, said first wall and said second wall being annular in shape, said heat sink assembly having a central void defined by said first wall, said heat sink assembly having a void, said void being intermediate said first wall and said second wall, said void having a heat sink material disposed therein; and a motor, said motor being an electric motor, said motor being disposed within said central void of said heat sink assembly.

2. The gas removal apparatus as recited in claim 1, wherein said electric motor is a direct current motor.

3. The gas removal apparatus as recited in claim 2, wherein said interior volume of said upper portion of said motor assembly has said circuit board disposed therein, said circuit board being hermetically sealed from its external surroundings by said lid member.

4. The gas removal apparatus as recited in claim 3, and further including a controller, said controller being operably coupled to said motor assembly, said controller configured to provide rotational speed control of said fan.

5. The gas removal apparatus as recited in claim 4, wherein said heat sink material is manufactured from copper or aluminum.

6. The gas removal apparatus as recited in claim 5, wherein said upper portion of said motor assembly is waterproof.

7. The gas removal apparatus as recited in claim 6, wherein said upper portion of said motor assembly is manufactured from metal.

8. A radon gas removal apparatus configured to remove radon gas from a building and an area proximate thereto wherein the radon gas removal apparatus comprises:

an exterior housing, said exterior housing having a lower portion and an upper portion, said lower portion of said exterior housing and said upper portion of said exterior housing being releasably secured, said exterior housing having an interior volume, said lower portion of said exterior housing having a central bore journaled therethrough, said lower portion of said exterior housing having a wall disposed within said interior volume of said exterior housing surrounding said central bore, said wall having a mounting member operably secured thereto, said mounting member having an upper portion and a lower portion, said upper and said lower portions of said mounting member being contiguously formed, said lower portion of said mounting member having a diameter that is less than that of the upper portion of said mounting member, said lower portion of said mounting member being coupled to the wall surrounding said central bore, said upper portion of said mounting member having a cavity, said mounting member being manufactured from rubber;

a fan, said fan being disposed within said interior volume of said exterior housing, said fan being disposed within said cavity of said mounting member;

a motor assembly, said motor assembly being operably coupled to said fan, said motor assembly having an upper portion, said upper portion of said motor assembly having a sidewall and a bottom defining an interior volume of said upper portion of said motor assembly, said upper portion of said motor assembly having an opening, said opening providing access to said interior volume of said upper portion of said motor assembly, said motor assembly having a lid member, said lid member configured to hermetically seal said interior volume of said upper portion of said motor assembly, said interior volume of said upper portion of said motor assembly having a circuit board disposed therein, said upper portion of said motor assembly having an upper edge and a lower edge;

a heat sink assembly, said heat sink assembly being proximate said lower edge of said upper portion of said motor assembly, said heat sink assembly having a first wall and a second wall, said first wall and said second wall being annular in shape, said heat sink assembly having a central void defined by said first wall, said heat sink assembly having a void, said void being intermediate said first wall and said second wall, said void having a heat sink material disposed therein; and a motor, said motor being an electric motor, said motor being disposed within said central void of said heat sink assembly.

* * * * *